US005262264A

United States Patent [19]

Shimizu et al.

[11] Patent Number: 5,262,264

[45] Date of Patent: Nov. 16, 1993

[54] COMBINATION OF COLOR TONERS FOR DEVELOPING ELECTROSTATIC LATENT IMAGE

[75] Inventors: Seiichi Shimizu, Saitama; Yoshiyuki Iwanari; Masahiro Yoshida, both of Tokyo; Noboru Nakaibayashi; Shinji Amaya, both of Saitama, all of Japan

[73] Assignee: Dainippon Ink and Chemical, Inc., Tokyo, Japan

[21] Appl. No.: 661,027

[22] Filed: Feb. 26, 1991

[30] Foreign Application Priority Data

Feb. 27, 1990 [JP] Japan ..... 2-46802
Aug. 21, 1990 [JP] Japan ..... 2-219726

[51] Int. Cl.[5] ..... G03G 9/09
[52] U.S. Cl. ..... 430/106; 430/45
[58] Field of Search ..... 430/106, 45, 107, 106.6, 430/138, 110

[56] References Cited

U.S. PATENT DOCUMENTS

| | | | |
|---|---|---|---|
| 4,599,285 | 7/1986 | Haneda et al. | 430/54 |
| 4,859,559 | 8/1989 | Trout | 430/115 |
| 4,869,981 | 9/1989 | Wing, Jr. et al. | 430/42 |
| 4,897,330 | 1/1990 | Shoji et al. | 430/54 |
| 4,931,370 | 6/1990 | Amaya et al. | 430/45 |

*Primary Examiner*—Marion E. McCamish
*Assistant Examiner*—Rosemary Ashton
*Attorney, Agent, or Firm*—Armstrong, Westerman, Hattori, McLeland & Naughton

[57] ABSTRACT

A magenta toner, a yellow toner, a cyan toner, and a black toner each for development of an electrostatic latent image ad a combination of the four color toners for obtaining a full color image are disclosed, the magenta toner containing a naphthol type organic pigment represented by formula (I):

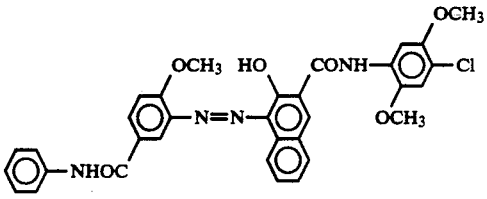

the yellow toner containing a disazo type organic pigment represented by formula (II):

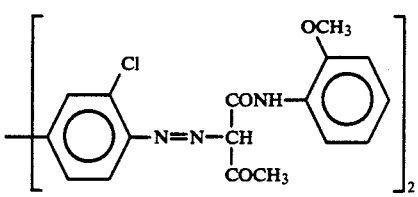

the cyan toner containing a $\beta$ type copper phthalocyanine pigment and a polychlorocopper phthalocyanine pigment, and the black toner containing at least one of an isoindolinone type yellow pigment and a tetrachloroisoindolinone type yellow pigment, at least one of a quinacridone type red pigment and a perylene type red pigment, and a phthalocyanine type blue pigment. The color toners are unaffected by environmental changes and capable of providing color images having stable characteristics.

2 Claims, No Drawings

COMBINATION OF COLOR TONERS FOR DEVELOPING ELECTROSTATIC LATENT IMAGE

FIELD OF THE INVENTION

This invention relates to a color toner for developing an electrostatic latent image in electrophotography, electrostatic recording, electrostatic printing, etc.

BACKGROUND OF THE INVENTION

Electrophotography generally consists of charging an electrophotographic photoreceptor comprising a photoconductor, exposing the photoreceptor to light to form an electrostatic latent image thereon, developing the latent image with a toner composition comprising a binder resin having dispersed therein a colorant, and transferring and fixing the developed toner image onto transfer paper, etc. to obtain a visible image.

Toner compositions widely employed for obtaining a visible image generally comprise a binder resin having dispersed therein a black colorant, such as carbon black. In recent years, color toners comprising a binder resin having dispersed therein a cyan pigment, a magenta pigment or a yellow pigment have been used. These color toners are also employed for obtaining a multicolor image by electrophotographic techniques usually as a combination of color toners of four colors: cyan, magenta, yellow, and black. Where the color toners are applied to an over-head projector (OHP) system, it is required that a color toner image transferred and fixed onto an OHP sheet is projected by transmitted light on a screen to provide a clear color image.

In general, a color toner comprises a binder resin, a colorant, and various additives. Commonly employed binder resins include polystyrene, styrene-(meth)acrylic ester copolymers, styrene-butadiene copolymers, polyester, epoxy resins, and coumaroneindene resins.

A multicolor image is obtained by repetition of exposure to monochromatic light by means of color separation filters, development of each latent image with a corresponding color toner, e.g., a yellow toner, a magenta toner, a cyan toner, and a black toner, and transfer and fixing of each toner image onto transfer paper, etc.

Many techniques concerning color toners have been proposed to date. With respect to magenta color toners, for example, JP-A-51-24234 (the term "JP-A" as used herein means an "unexamined published Japanese patent application") discloses a magenta toner containing a quinacridone pigment, and JP-A-59-165069 and JP-A-62-296167 disclose magenta toners containing various monoazo pigments.

However, these conventional color toners have difficulty in maintaining a predetermined quantity of charge in a stable manner against environmental changes from a low-temperature (e.g., 10° C.) and low-humidity (e.g., 20% RH) condition to a high-temperature (e.g., 40° C.) and high-humidity (e.g., 90% RH) condition so that image characteristics are extremely liable to variations depending on environmental conditions.

On the other hand, a multicolor toner image obtained by repetition of development with magenta, cyan, yellow, and black toners is generally demanded to have an image quality close to natural colors. To meet this demand, it is important for each of magenta, cyan, yellow, and black toners to have excellent coloring power and satisfactory color reproducibility, and there has been a need for further improvements.

SUMMARY OF THE INVENTION

An object of the present invention is to provide a color toner for developing an electrostatic latent image whose chargeability is unaffected by environmental changes of from low-temperature and low-humidity to high-temperature and high-humidity so as to provide a satisfactory transfer image in a stable manner.

Another object of the present invention is to provide a combination of color toners for multicolor development of an electrostatic latent image which provides a clear transfer image extremely close to natural colors.

The inventors have conducted extensive studies and, as a result, reached the present invention.

According to a first embodiment of this invention, there is provided a magenta toner for development of an electrostatic latent image which contains a naphthol type organic pigment represented by formula (I) as a colorant:

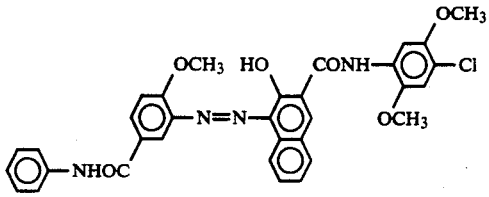

(I)

According to a second embodiment of this invention, there is provided a yellow toner for development of an electrostatic latent image which contains a disazo type organic pigment represented by formula (II) as a colorant:

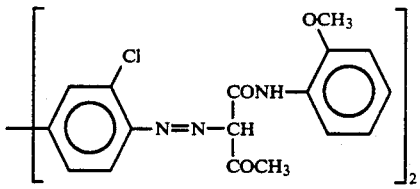

(II)

According to a third embodiment of this invention, there is provided a cyan toner for development of an electrostatic latent image which contains a $\beta$ type copper phthalocyanine pigment and a polychlorocopper phthalocyanine pigment as colorants.

According to a fourth embodiment of this invention, there is provided a black toner for development of an electrostatic latent image which contains at least one of an isoindolinone type yellow pigment and a tetrachloroisoindolinone type yellow pigment, at least one of a quinacridone type red pigment and a perylene type red pigment, and a phthalocyanine type blue pigment as colorants.

According to a fifth embodiment of this invention, there is provided a combination of the above-described magenta, yellow, cyan, and black toners for multicolor development of an electrostatic latent image.

DETAILED DESCRIPTION OF THE INVENTION

The naphthol type organic pigment represented by formula (I) which can be used in the magenta toner of the present invention preferably includes C.I. Pigment Red 184, which is commercially available, for example, from Hoechst Co. under the trade name of "Permanent Rubine F-6B".

The disazo type organic pigment represented by formula (II) which can be used in the yellow toner of the present invention preferably includes C.I. Pigment Yellow 7, which is commercially available, for example, from Dainippon Ink & Chemicals, Inc. under the trade name of "Symuler Fast Yellow 8GF".

The $\beta$ type copper phthalocyanine pigment which can be used in the cyan toner of the present invention preferably includes C.I. Pigment 15:3, which is commercially available, for example, from Dainippon Ink & Chemicals, Inc. under the trade name of "Fastogen Blue TGR".

The polychlorocopper phthalocyanine pigment which can be used in the cyan toner of the present invention preferably includes C.I. Pigment Green 7, which is commercially available, for example, from Dainippon Ink & Chemicals, Inc. under the trade name of "Fastogen Green S".

The polychlorocopper phthalocyanine pigment is preferably used in a weight ratio of from 1 to 20% based on the sum of a $\beta$ type copper phthalocyanine pigment and a polychlorocopper phthalocyanine pigment.

The tetrachloroisoindolinone type yellow pigment which can be used in the black toner of the present invention preferably includes Fastogen Super Yellow GR, Fastogen Super Yellow GRO, and Fastogen Super Yellow GROH produced by Dainippon Ink & Chemicals, Inc.

The quinacridone type red pigment which can be used in the black toner of the present invention preferably includes Fastogen Super Magenta R, Fastogen Super Magenta RH, Fastogen Super Magenta HS, Fastogen Super Red 2Y, Fastogen Super Red BN, Fastogen Super Red YE, and Fastogen Super Red 5B produced by Dainippon Ink & Chemicals, Inc.

The perylene type red pigment which can be used in the black toner of the present invention preferably includes PV FAST Red B produced by Hoechst, PERRINDO RED R-6418 produced by Bayer, and PALIOGEN-RED L 3340 and PALIOGEN-RED L 3530 produced by BASF.

The phthalocyanine type blue pigment which can be used in the present invention preferably includes Fastogen Blue GNPT, Fastogen Blue 5380E, Fastogen Blue NK, Fastogen Blue 5485, Fastogen Blue FGF, Fastogen Blue GNPR, and Fastogen Blue GNPS, produced by Dainippon Ink & Chemicals, Inc.

In the black toner which can be used in the present invention, it is preferred that the content of the blue pigment is higher than that of the yellow pigment and the content of the red pigment is higher than that of the blue pigment.

Binder resins which can be used in the color toners of the present invention include polystyrene, styrene-(meth)acrylic ester copolymers, styrene-butadiene copolymers, polyester, epoxy resins, butyral resins, xylene resins, and coumaroneindene resins. For use in full color development, in order to satisfy full color reproducibility, OHP light transmitting properties, and fixing strength, it is desirable that the viscosity of a binder resin at the time of toner fixing is lower than that of a binder resin in black toners for general copying machines. Preferred examples of such a binder resin are polyester resins and epoxy resins.

However, because polyester resins and epoxy resins contain many hydrophilic groups, e.g., a carboxyl group and a hydroxyl group, in the molecule thereof, they show a tendency to have increased hygroscopicity as compared with commonly employed polystyrene or styrene-acrylic ester copolymer resins. As a result, chargeability of toners using these binder resins is liable to vary with environmental changes.

In order to avoid the above-mentioned disadvantage, it is more preferable to use vinyl-modified polyester resins prepared by graft polymerizing a specific amount of an aromatic vinyl monomer and an amino-containing vinyl monomer to an unsaturated polyester resin comprising at least an unsaturated aliphatic dibasic acid and a polyhydric alcohol.

The vinyl-modified polyester resin has a reduced content of hydrophilic groups as compared with unmodified unsaturated polyester containing a hydrophilic group such as a carboxyl group and a hydroxyl group and therefore has reduced hygroscopicity. On account of this, liability to variations of chargeability with environmental changes can be reduced while maintaining characteristics of polyester resins, i.e., satisfactory full color reproducibility, OHP light transmitting properties, and proper fixing strength.

Besides being effective to reduce hygroscopicity, the amino-containing vinyl monomer also serves to stabilize a quantity of charge given to the toner. That is, when it is present in an amount of from 0.1 to 2.0% by weight based on the vinyl-modified polyester resin, positive chargeability possessed by an amino group is imparted to negative chargeability of polyester and, as a result, the toner as a whole becomes static-free or weakly positive-static. Thus, a desired quantity of charge can be obtained by using a negative charge control agent (e.g., a metal complex compound of salicylic acid and an ester of salicylic acid and alkyl alcohol) in combination.

In more detail, the above-mentioned binder resin which can be preferably used in the present invention is a graft polymer having a weight-average molecular weight of from 8,000 to 20,000, a melt viscosity of from $1\times10^4$ to $1\times10^6$ P (poise) at 100° C., and a glass transition temperature (Tg) of from 50 to 75° C. which is obtained by graft polymerizing (1) a vinyl monomer mixture comprising (i) at least 50% by weight of an aromatic vinyl monomer and (ii) from 1 to 30% by weight of an amino-containing vinyl monomer to (2) a polyester resin having a weight-average molecular weight of from 5,000 to 12,000 which is constituted of (iii) a polycarboxylic acid component containing an aliphatic unsaturated dibasic acid in such an amount as to form a proportion of from 0.2 to 2.0% by weight in the polyester resin and (iv) a diol component having a propylidenediphenyl group in the molecule thereof, the weight ratio of the polyester to the vinyl monomer being 30:70 to 90:10, preferably 50:50 to 90:10.

Examples of suitable aliphatic unsaturated dibasic acids include maleic acid, maleic anhydride, fumaric acid, itaconic acid, and citraconic acid. Other usable polycarboxylic acids include dibasic acids, e.g., phthalic anhydride, terephthalic acid, isophthalic acid, orthophthalic acid, hexahydrophthalic acid anhydride, tetrahydrophthalic acid anhydride, cyclohexanedicarboxylic acid, methylcyclohexanedicarboxylic acid, succinic acid, malonic acid, glutaric acid, adipic acid, azelaic acid, sebacic acid, and alkyl- or alkenylsuccinic acids having from 4 to 18 carbon atoms in the alkyl or alkenyl moiety thereof.

Examples of suitable diols having a propylidenediphenyl group in the molecule thereof include hydrogenated bisphenol A, a propylene oxide adduct of bisphenol A, and an ethylene oxide adduct of bisphenol A. An average number of moles of the added alkylene oxide in the alkylene oxide adducts is suitably from 2 to 7. An adduct having both propylene oxide and ethylene oxide added is also usable.

The above-mentioned bisphenol type diol may be replaced with other polyols in a proportion up to about 10 mol% based on the total polyol components. Examples of other usable polyols are ethylene glycol, propylene glycol, neopentyl glycol, and 3,3,5-trimethyl-2,4-pentanediol.

In addition to these components, the polyester resin preferably contains a trifunctional compound, e.g., trimellitic anhydride, glycerin, and trimethylolpropane, unless the polyester resin undergoes gelation. Further, a monofunctional compound, e.g., benzoic acid, p-t-butylbenzoic acid, and cyclohexanol, may be used appropriately as a molecular weight regulator for the polyester resin.

The weight-average molecular weight of the polyester resin suitably ranges from 5,000 to 12,000. If it is less than 5,000, the resulting vinyl-modified resin is too brittle to have sufficient durability as a toner. If it is too large exceeding 12,000, the polyester resin is apt to be gelled during graft polymerization, failing to obtain a satisfactory graft polymer.

Among the components constituting the polyester resin, the aliphatic unsaturated dibasic acid is an important component because it not only functions as a grafting active site but also is essential for introducing a partially crosslinked structure into a graft polymer. If the proportion of the aliphatic unsaturated dibasic acid in the polyester resin is less than 0.2% by weight, graft polymerization is hard to accomplish. If it exceeds 2% by weight, the polyester resin is ready to gel. The most suitable aliphatic unsaturated dibasic acid is maleic anhydride.

The polyester resin can be prepared by polycondensation of the polycarboxylic acid component and the diol component at a temperature of from 180° to 250° C. in an inert gas atmosphere. Commonly employed catalysts for esterification, e.g., zinc oxide, stannous oxide, dibutyl tin oxide, and dibutyl tin dilaurate, may be utilized for accelerating the reaction. For reaction acceleration, the reaction may be conducted under reduced pressure.

The graft polymer according to the present invention can be obtained by graft polymerizing a vinyl monomer mixture to the thus prepared polyester resin, the weight ratio of the polyester to the vinyl monomer being from 30:70 to 90:10, preferably 50:50 to 90:10. If the amount of the polyester resin is less than 30% by weight, a toner having satisfactory fixing properties and leveling (or surface smoothness) aimed at in the present invention cannot be obtained. If the amount of the polyester resin exceeds 90% by weight, the resulting graft polymer predominantly exhibits negative chargeability so that it is difficult to control a quantity of charge of the toner mainly comprising the vinyl-modified polyester resin and colorants even with a negative charge control agent.

Examples of suitable amino-containing vinyl monomer which is an essential component of a grafting vinyl monomer mixture include dimethylaminoethyl methacrylate, diethylaminoethyl methacrylate, dimethylaminoethyl acrylate, and dimethylaminopropylmethacrylamide. The amino-containing vinyl monomer is used in an amount of from 1 to 30% by weight, and preferably from 1 to 20% by weight, based on the vinyl monomer mixture. If the amount of the amino-containing vinyl monomer is less than 1% by weight, the resulting vinyl-modified polyester resin becomes negatively chargeable as a whole, making it difficult to control a charge quantity with a negative charge control agent. If it exceeds 30% by weight, positive chargeability becomes predominant, resulting in difficulty in making the toner negatively chargeable as a whole.

Examples of suitable aromatic vinyl monomer which is another essential component of the grafting vinyl monomer mixture include styrene, α-methylstyrene, vinyltoluene, and p-ethylstyrene.

Other vinyl monomers which may constitute the vinyl monomer mixture include alkyl methacrylates, e.g., methyl methacrylate, butyl methacrylate, octyl methacrylate and stearyl methacrylate; alkyl acrylates, e.g., ethyl acrylate, propyl acrylate, butyl acrylate, and octyl acrylate; acrylonitrile, and acrylamide.

Graft polymerization can be carried out by solution polymerization or suspension polymerization. Solution polymerization is performed by adding the vinyl monomer mixture and a polymerization initiator to a solution of the polyester resin in a solvent, e.g., xylene and toluene, and allowing the system to polymerize at a temperature of from 60° to 150° C in an inert gas atmosphere. Suspension polymerization is performed by dissolving the polyester resin and a polymerization initiator in the vinyl monomer mixture and dispersing the solution in water containing a suspension stabilizer such as polyvinyl alcohol, gelatin, methyl cellulose, etc. to conduct polymerization under the same conditions as in solution polymerization. Suitable polymerization initiators include azo type compounds, e.g., azobisisobutyronitrile and azobisdimethylvaleronitrile.

A suitable weight-average molecular weight of the graft polymer is from 8,000 to 20,000. If desired, a chain transfer agent, e.g., dodecylmercaptan and thiophenol, may be used. If the weight-average molecular weight of the graft polymer is less than 8,000, the graft polymer is too brittle for use as a binder resin. If it exceeds 20,000, a toner composition having satisfactory fixing properties and leveling as aimed at in the present invention cannot be obtained.

The graft polymer preferably has a Tg of from 50 to 75° C., and more preferably from 55° to 70° C., as measured by differential thermal analysis. Too a low Tg tends to cause blocking of toner particles, and too a high Tg deteriorates fixing properties. The terminology "glass transition temperature (Tg)" as used herein means an endothermic peak temperature in differential thermal analysis.

The graft polymer suitably has a melt viscosity of from $1\times10^4$ to $1\times10^6$ P, and preferably from $5\times10^4$ to $5\times10^5$ P, at 100° C. as measured by flow test. Too a low melt viscosity deteriorates resistance to offset. If a graft polymer having too a high melt viscosity is used in OHP, the toner layer fixed on an OHP sheet has poor leveling so that transmitted light is scattered only to provide a blackish transmission image of low saturation.

The magenta toner, yellow toner, cyan toner, and black toner according to the present invention exhibit chargeability unaffected by environmental changes of from low-temperature and low-humidity to high-temperature and high-humidity to stably provide a satisfactory transfer image. These color toners, when combined to carry out multicolor development, provide a clear multicolor image extremely close to an original.

In the present invention, the content of the pigments for yellow, magenta or cyan toners is preferably from 2 to 10% by weight, and the content of the pigments for black toner is preferably from 5 to 15% by weight, based on the binder resin content.

The present invention is now illustrated in greater detail with reference to Examples, but it should be understood that the present invention is not deemed to be limited thereto. All the parts, percents and ratios are given by weight unless otherwise indicated.

EXAMPLE 1

Preparation of Resin

In a flask were charged 64 parts of 2,2,-bis[p-(2-hydroxyethoxy)phenyl]propane, 16 parts of isophthalic acid, 16 parts of terephthalic acid, 0.6 part of maleic anhydride, and 0.06 part of dibutyl tin oxide, and the mixture was allowed to react at 230° C. for 24 hours in a nitrogen atmosphere. The resulting polyester resin (designated as resin A) had a weight-average molecular weight of 7,600.

Fifty parts of resin A were dissolved in 50 parts of xylene in a flask, and the solution was heated to the reflux temperature of xylene. A solution of 0.4 part of azobisisobutyronitrile in 13 parts of styrene and 0.3 part of diethylaminoethyl methacrylate was added dropwise to the xylene solution over about 30 minutes while refluxing. After the addition, the mixture was kept at that temperature for 3 hours. Then, xylene was removed by distillation under reduced pressure to collect the residual vinyl-modified polyester resin (designated as resin B). Resin B had a weight-average molecular weight of 12,000, a melt viscosity of $5\times10^4$ P at 100° C., and a Tg of 62° C.

The melt viscosity of resin B was measured with a flow tester ("CFT-500" manufactured by Shimazu Seisakusho Ltd.; nozzle diameter: 1 mm; nozzle length: 1 mm) at a rate of temperature rise of 3° C./min under a load of 30 kg.

Preparation of Toner

Ninety-four parts of resin B prepared above were mixed with 3 parts of Permanent Rubine F-6B (produced by Hoechst), and 3 parts of Bontron E-84 (produced by Orient Chemical Co., Ltd.) in a ball mill, and the mixture was kneaded in a heat roll. After cooling, the blend was finely ground by means of a jet mill and classified to obtain a magenta toner (1) having an average particle size of 11 μm.

Preparation of Developer

Four parts of toner (1) and 96 parts of a charge carrier ("Ferrite Carrier F-150" produced by Powder Tec Co.) were mixed by friction to prepare a developer.

EXAMPLE 2

A yellow toner (2) was prepared in the same manner as in Example 1, except for replacing Permanent Rubine F-6B with Symuler Fast Yellow 8GF (produced by Dainippon Ink & Chemicals), and a developer was prepared using the resulting yellow toner in the same manner as in Example 1.

EXAMPLE 3

A cyan toner (3) was prepared in the same manner as in Example 1, except for replacing 3 parts of Permanent Rubine F-6B with 2.82 parts of Fastogen Blue TGR (produced by Dainippon Ink & Chemicals) and 0.18 part of Fastogen Green S (produced by Dainippon Ink & Chemicals), and a developer was prepared using the resulting cyan toner in the same manner as in Example 1.

EXAMPLE 4

A black toner (4) was prepared in the same manner as in Example 1, except for replacing 3 parts of Permanent Rubine F-6B with 2 parts of Fastogen Super Yellow GRO (isoindolinone type yellow pigment, produced by Dainippon Ink & Chemicals), 5 parts of PV FAST RED B (perylene type red pigment, produced by Hoechst), and 3.5 parts of Fastogen Blue TGR (phthalocyanine type blue pigment, produced by Dainippon Ink & Chemicals), and a developer was prepared using the resulting black toner in the same manner as in Example 1.

Evaluation

Each of the developers obtained in Examples 1 through 4 was allowed to stand for one hour under three different conditions: a high-temperature and high-humidity condition (40° C., 90% RH), an ambient-temperature and ambient-humidity condition (20° C., 50% RH), and a low-temperature and low-humidity condition (10° C., 20% RH). Immediately thereafter, the quantity of charge of each developer was measured. A change in charge quantity due to a change of environmental conditions was calculated. The results obtained are shown in Table 1 below.

TABLE 1

| Example No. | Quantity of Charge (μc/g) 10° C., 20% RH | 20° C., 50% RH | 40° C. 90% RH | Difference* | Evaluation |
|---|---|---|---|---|---|
| 1 | −18 | −14 | −12 | 6 | Good |
| 2 | −19 | −15 | −14 | 5 | Good |
| 3 | −19 | −16 | −13 | 6 | Good |
| 4 | −17 | −13 | −11 | 6 | Good |

Note:
*Difference in quantity of charge between 10° C., 20% RH and 40° C., 90% RH.

As is apparent from the results in Table 1, the developers using the toners according to the present invention undergo little change in quantity of charge with changes in environmental condition and, therefore, prove to provide a satisfactory transfer image in a stable manner.

EXAMPLE 5

A full color original was copied by means of a modified model of a copying machine "BD 3504" manufactured by Toshiba using magenta toner (1), yellow toner (2), cyan toner (3), and black toner (4). As a result, high quality copies having full color very close to the original were obtained.

EXAMPLE 6

Magenta toner (1'), yellow toner (2'), cyan toner (3'), and black toner (4,) were prepared in the same manner as in Examples 1, 2, 3, and 4, respectively, except for replacing resin B with resin A.

A full color original was copied in the same manner as in Example 5, except for using toners (1'), (2'), (3'), and (4'). As a result, high quality copies having full color very close to the original were obtained.

EXAMPLE 7

Magenta toner (1'), yellow toner (2'), cyan toner (3'), and black toner (4') were prepared in the same manner as in Examples 1, 2, 3, and 4, respectively, except for replacing resin B with "Epichlon 4050" (produced by Dainippon Ink & Chemicals).

A full color original was copied in the same manner as in Example 5, except for using toners (1'), (2'), (3'), and (4'). As a result, high quality copies having full color very close to the original were obtained.

While the invention has been described in detail and with reference to specific examples thereof, it will be apparent to one skilled in the art that various changes and modifications can be made therein without departing from the spirit and scope thereof.

What is claimed is:

1. A combination of four color toners for multi-image exposure to monochromatic light and for stepwise development of electrostatic latent images to form a full color image, the combination consisting of a magenta toner, a yellow toner, a cyan toner, and a black toner, wherein said magenta toner contains a naphthol type organic pigment represented by formula (I) as a colorant:

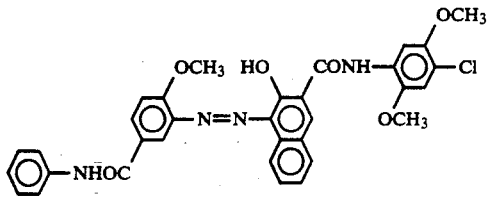

(I)

said yellow toner contains a disazo type organic pigment represented by formula (II) as a colorant:

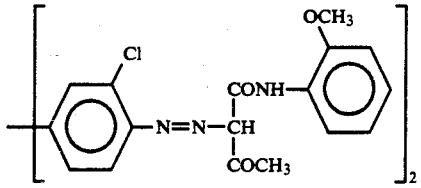

(II)

said cyan toner contains a $\beta$ type copper phthalocyanine pigment and a polychlorocopper phthalocyanine pigment as colorants, and said black toner contains at least one of an isoindolinone type yellow pigment and tetrachloroisoindolinone type yellow pigment, at least one of a quinacridone type red pigment and a perylene type red pigment, and a phthalocyanine type blue pigment as colorants.

2. A combination of four color toners as claimed in claim 1, wherein said magenta toner, yellow toner, cyan toner and black toner each contain a binder resin comprising a vinyl-modified polyester resin prepared by graft polymerizing an aromatic vinyl monomer and an amino-containing vinyl monomer to an unsaturated polyester resin.

* * * * *